US005859517A

United States Patent [19]

DePasqua

[11] Patent Number: 5,859,517

[45] Date of Patent: Jan. 12, 1999

[54] TROLLING MOTOR CONTROLLER

[76] Inventor: Louis DePasqua, 49 W. Tall Grass Ct., Round Lake Beach, Ill. 60073

[21] Appl. No.: 827,948

[22] Filed: May 1, 1997

[51] Int. Cl.[6] ..... B64C 13/20

[52] U.S. Cl. ..... 318/581; 318/16; 114/144 R

[58] Field of Search ..... 318/16, 581; 114/144 R; 440/6, 581

[56] References Cited

U.S. PATENT DOCUMENTS 4,614,900 9/1986 Young ..... 318/16

4,824,408 4/1989 Aertker et al. ..... 440/6

5,606,930 3/1997 LeBlanc et al. ..... 114/144 R

*Primary Examiner*—Karen Masih

*Attorney, Agent, or Firm*—Francis C. Kowalik

[57] ABSTRACT

The instant invention relates to a controller for a fishing boat trolling motor wherein the controller comprehends a transmitter so configured as to be capable of being releasably affixed to a member such as a finger or fishing pole thereby allowing an angler to simultaneously move about the fishing boat and perform various sundry tasks requiring use of both hands while maintaining continuous control of the boat; thereby allowing for greater concentration to be applied to the task at hand while maintaining such control.

20 Claims, 6 Drawing Sheets

TROLLING MOTOR CONTROLLER

FIELD OF THE INVENTION

The instant invention relates to contrtollers for boat motors, more specifically wireless controllers for fishing boat trolling motors.

BACKGROUND OF THE INVENTION

Trolling motors have been long used by anglers to move their skiffs slowly through the water in search of fish. These motors, which are usually electric, are adapted to move a fishing skiff, bass boat or the like at a speed conducive to the use of triling lures such as "spinners" or other such lures which are designed to be pulled through the water.

Accurate control of these motors is essential for both the safety of the angler as well as to correctly poisition the lure so as to maximize the anglers take of fish. Previous controllers have been made so as to allow the angler to control the direction of the craft from a location remote from the trolling motor. U.S. Pat. No. 4,614,900 to Young discloses a remote control for a boat motor which is, in the first embodiment, activated by a foot pedal. The pedal allows for an up-and-down as well as left-and-right motion which corresponds to a like action of the trolling motor; in another embodiment, the controller is hand-held and discloses a switch to change direction as well as a second switch to turn the motor on or off.

U.S. Pat. No. 4,824,408 toAertker et al discloses a trolling motor controller having an analog control mechanism which is contained in a foot pedal. This device is adapted to be placed in a position in the boat and operated by the angler from such placed position.

Both Aertker and Young describe controllers which either occupy the use of a hand, thereby inhibiting the use of the hand for other uses without first putting down the controller, or conversely are operated by a foot pedal which essentially fixes the location of the angler within the boat. It is therefore apparent that these devices do not allow true freedom of the angler to perform the various tasks necessary or desired during fishing without, for a tiome, leaving the boat uncontrolled.

SUMMARY OF THE INVENTION

The instant invention discloses a remote control for a trolling motor which is adapted to allow an angler use of both hands while maintaining control of the boat as well as trolling the angler to move freely about the boat while maintaining control thereof.

The wireless control box uses two push button style switches, one to control the propeller on/off operation and one switch to control the bypass on/off operation. The propeller speed and steering position motors on the trolling motor are controlled by two variable potentiometers mounted into the wireless finger control. The propeller speed control is a standard mini knob style potentiometer control which provides infinite variable propeller speed. The steering motor's position control is provided by a center detent variable slider sytle potentiometer. This slider control gives the user infinite 360 degree trolling motor steering position with a click feel to the control when the center detent position is reached. The slider control is in the center detent position, this means the trolling motor is in the center, straight ahead steering position. This provides the fisherman the position of the trolling motor with the feel of a click. After getting familiar with the slide control, the use can set the direction of the trolling motor to any desired position without even looking at the direction of the trolling motor. This is what sets the finger controller apart from other style controllers. Another very similar finger control design incorporated seven mini push button switches to operate the speed up, speed down, steer left, steer right, auto-center, motor on/off and bypass operations of a trolling motor. The speed up and down switches control the propeller's speed. The steer left/right switches set the trolling motor's position motor in the desired direction of 360 degrees. The auto-center switch sets the direction of the trolling motor into the straight ahead, center position. The motor on/off switch turns the propeller on or off. The bypass switch allows the user to switch between the standard foot control and the finger control. The finger control is very small and lightweight, RF wireless and battery operated There are at least three ways to use the control box. One mounts on the index finger with a ring style mounting clip, one snaps onto the fishing pole with the aid of a pole mounting clip and can be switched from fishing pole to pole and one has the finger control box built into the fishing pole itself. The finger control box transmits eight bit codes to a receiver box which interprets the data codes. The receiver interfaces into the trolling motor via control relays and variable resistance circuits. The receiver also has an audible beep function with the use of a mini speaker, and when the propeller motor is activated, a beep is heard by the user indicating the motor is on. Two beeps in a row are heard upon turning the propeller off.

It is , therefore, a primary object of the invention to provide for a trolling motor controller so adapted as to allow the user thereof use of both hands whilst controlling said motor from a plurality of positions;

It is a second object of the invention to provide for a trolling motor controller adapted to be removably mounted on a member such a s a finger or fishing pole;

It is a third object of the invention to provide for a digital wireless control of a trolling motor;

It is a fourth object of the invention to provide for a trolling motor controller which allows for control of a boat simultaneously with the performance of other tasks;

It is a fifth object of the invention to provide for a boat motor controller adapted to allow for control of a variety of trolling motors;

It is a sixth object of the invention to provide for high frequency transmission of wireless signals from a trolling motor controller transmitter to a receiver therefor so as to limit possible interference with such transmission.

these and other objects of the instant invention will become apparent from the claims, drawings and detailed description of the preferred embodiment appended hereto.

DETAILED DESCRIPTION OF THE PREFFERED EMBODIMENT

Figure 1:
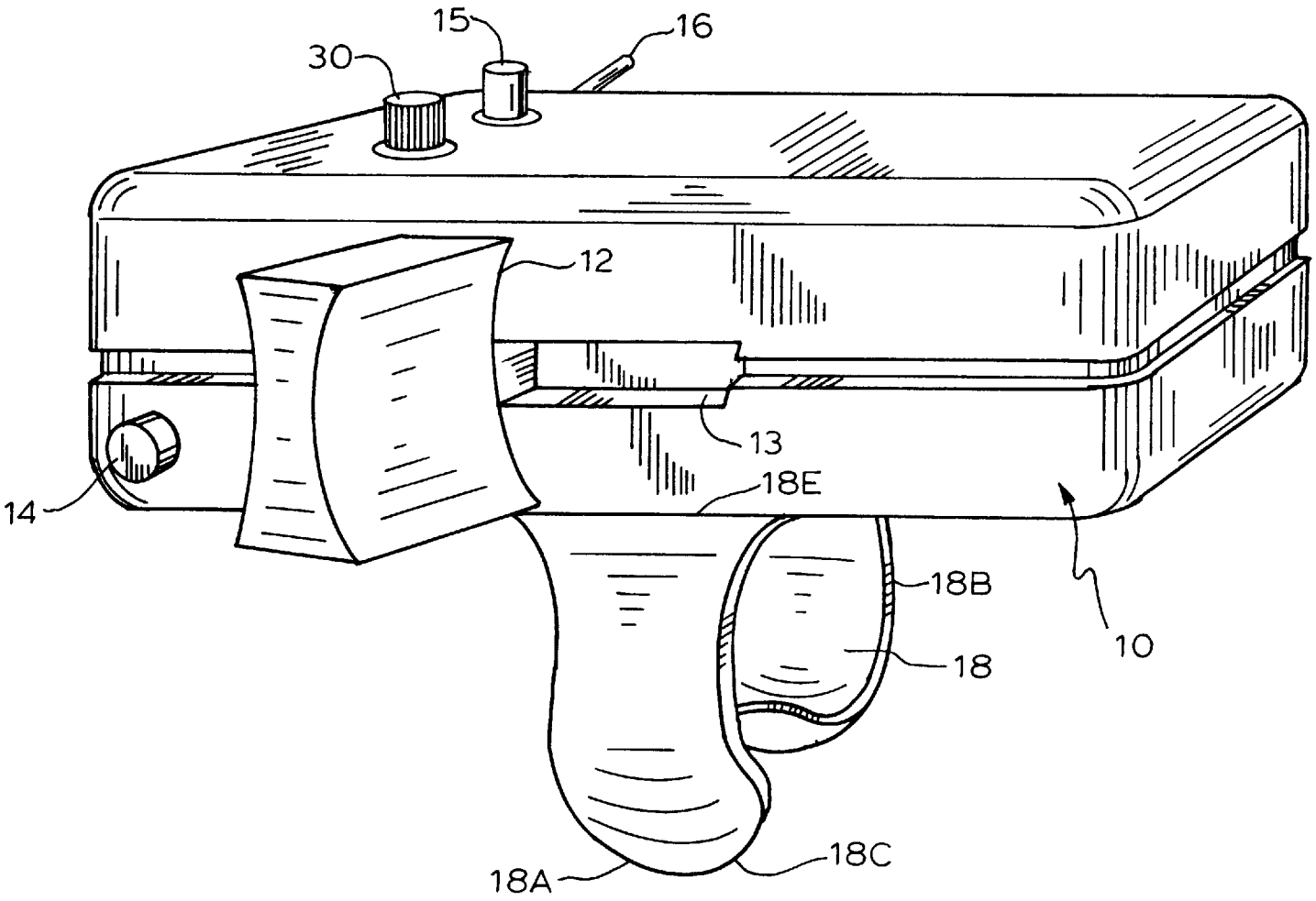
FIG. 1 is a perspective view of the controller transmitter.
Figure 2:
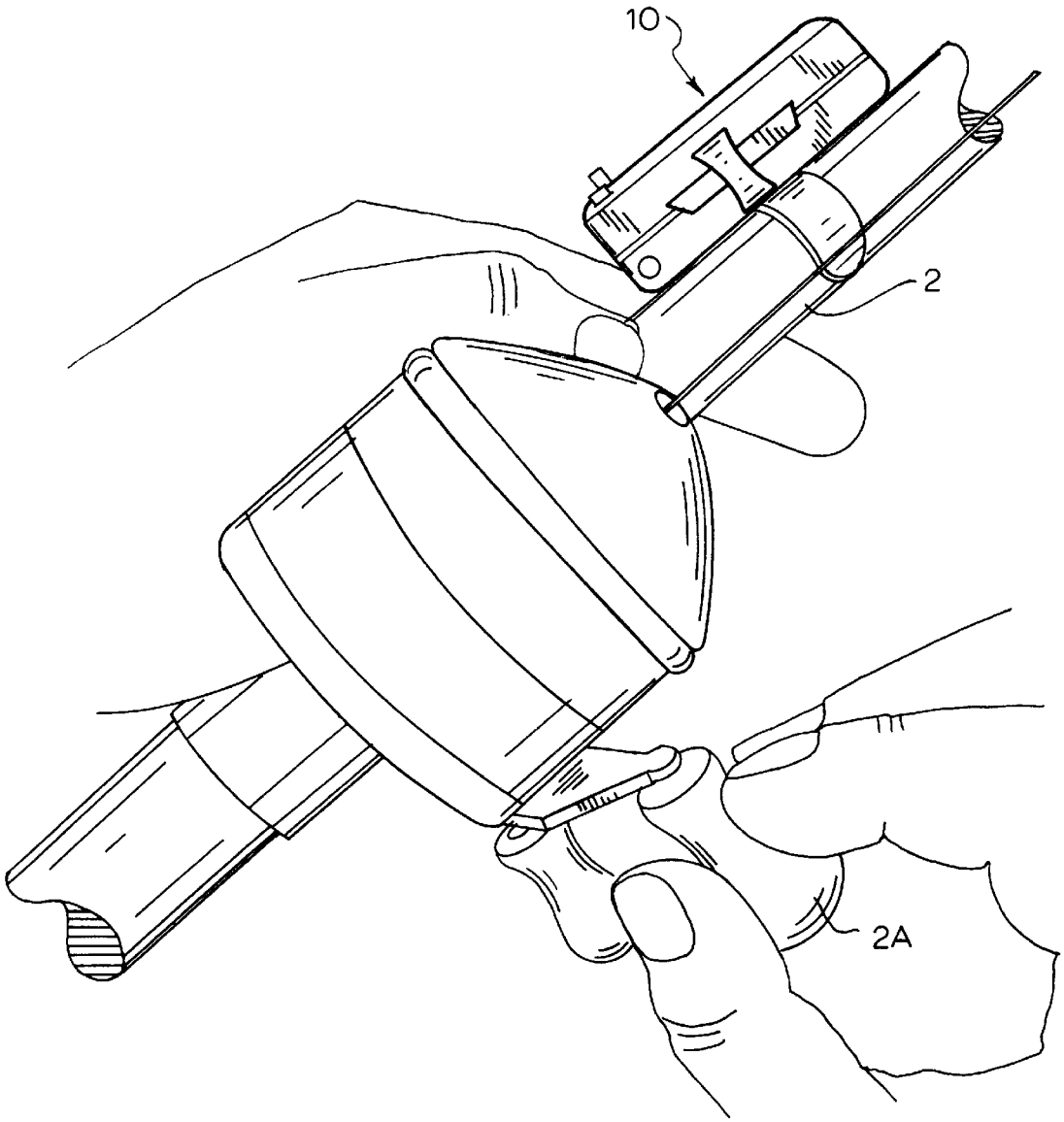
FIGS. 2 is a plan view of the controller transmitter as used with a fishing pole.
Figure 2A:
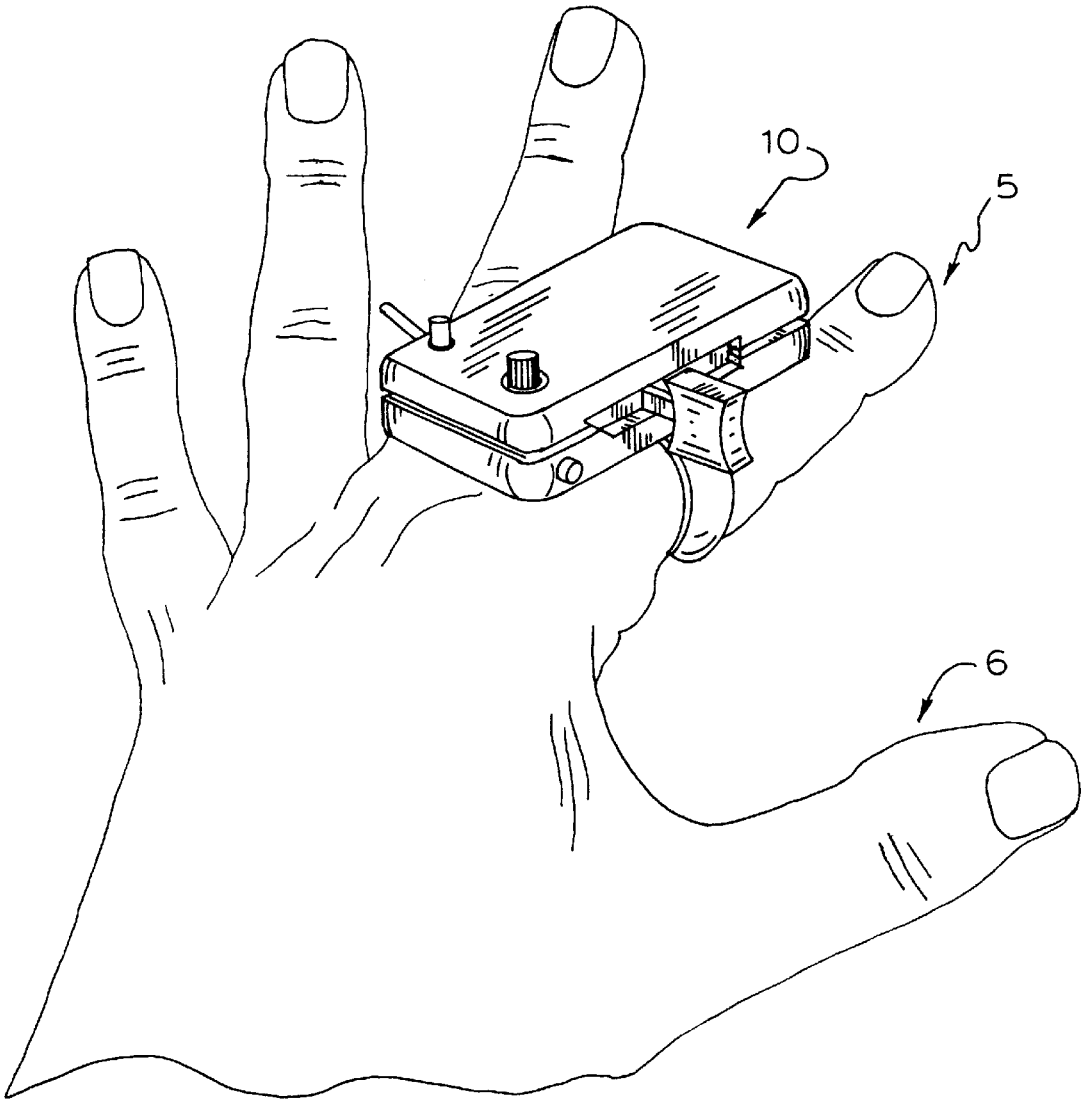
FIG. 2A is a perspective view of the controller transmitter as used on a hand.

Referring to FIG. 1, the finger control housing 10 contains a RF transmitter and CPU IC which reads all of the control switches and control potentiometers. The propeller motor switch 14 is used to turn on and off the trolling motor's propeller which moves the boat. This is, in the preferred embodiment, a momentary switch. The steering position slider potentiometer 12 has a center detent 13 which proportionally controls the position of the trolling motor's steering servo motor. When set to the center detent position 13, the trolling motor is positioned straight ahead in the center position. Moving the slider 12 to the right of the center turns the motor to the right. If pushed further right, the motor moves further right. There is a full 360 degree control over the motor's position with an accuracy of 255 positions. The speed of the propeller motor is infinitely controlable by the speed control potentiometer 30, wherein fully CCW rotation thereof equals zero speed and fully CW rotation corresponds to maximum propeller motor speed. The finger control 10 can be bypassed with the use of the bypass switch 15. The bypass switch 15 is, in the preferred embodiment, a momentary switch. Press once and the finger control operates. Press again and a standard foot control operates the trolling motor. The finger control 10 is also battery operated and can be turned on and off with the power switch 16. The finger controller unit is mounted onto the index finger 5 by the finger clip ring 18. As can be seen in FIG. 1, finger clip ring 18 comprehends a first extension 18A wherein the extension displays broad proximal and distal ends 18C, 18E and a narrower medial extension so as to provide flexibility of a first extension 18A. Across from first extension 18A is a cuplike extension 18B which serves to stabilize the transmitter housing 10 on whatever member to which it is attached. As can be seen in FIGS. 2 and 2A, the clip ring 18 allows for the transmitter box 10 to be attached to an operator's finger 5 while allowing operation thereof by the operator's thumb 6 thereby allowing free use of the hand for additional tasks. As can be seen in FIG. 2, the ring mounting clip 18 also allows for removable affixement of the transmitter 10 to other members such as a fishing pole 2 thereby allowing the operator to simultaneously operate the controller 10 and manipulate both the pole 2 and the reel 2A.

Figure 3:
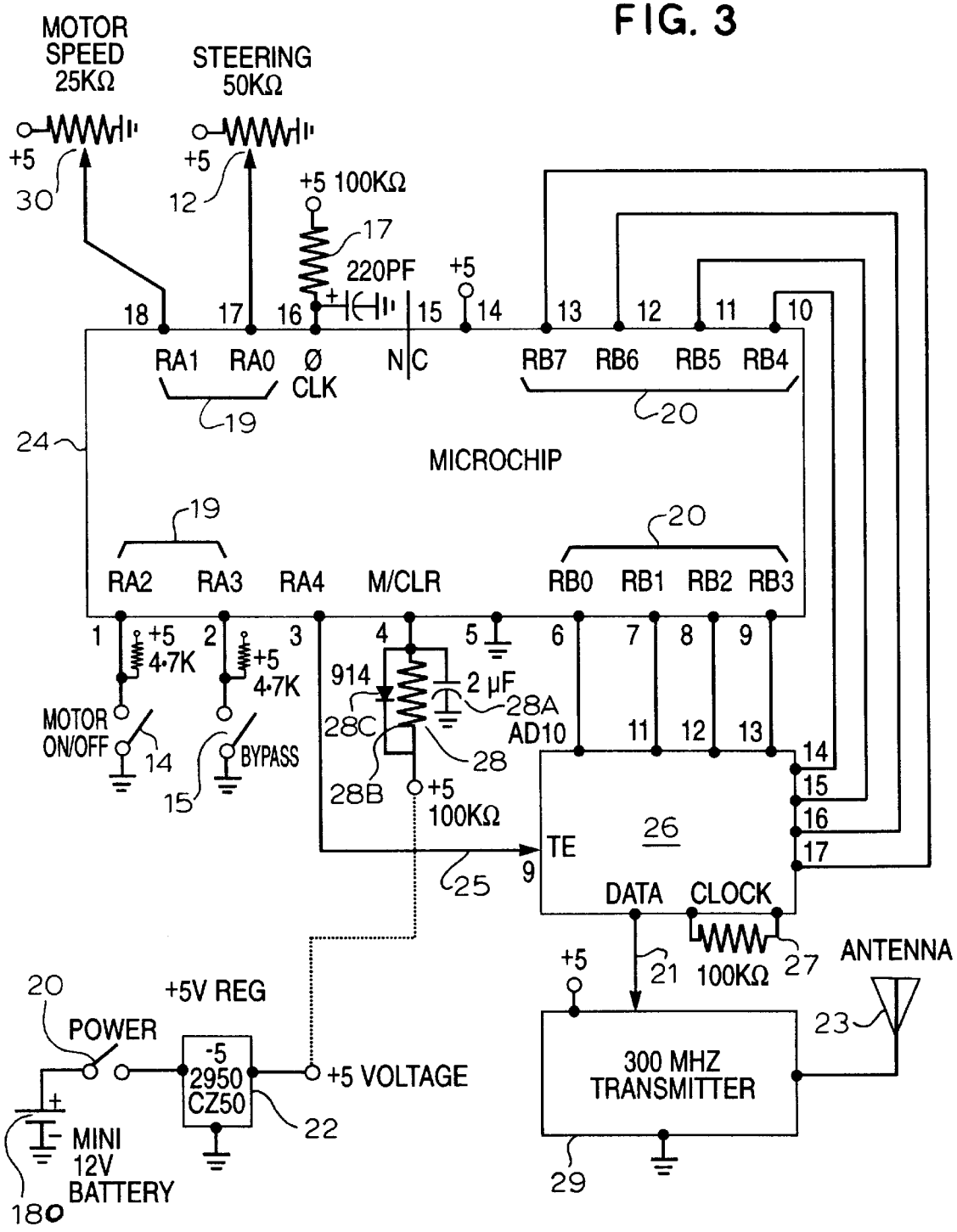
FIG. 3 is a schematic of the controller transmitter.
Figure 5:
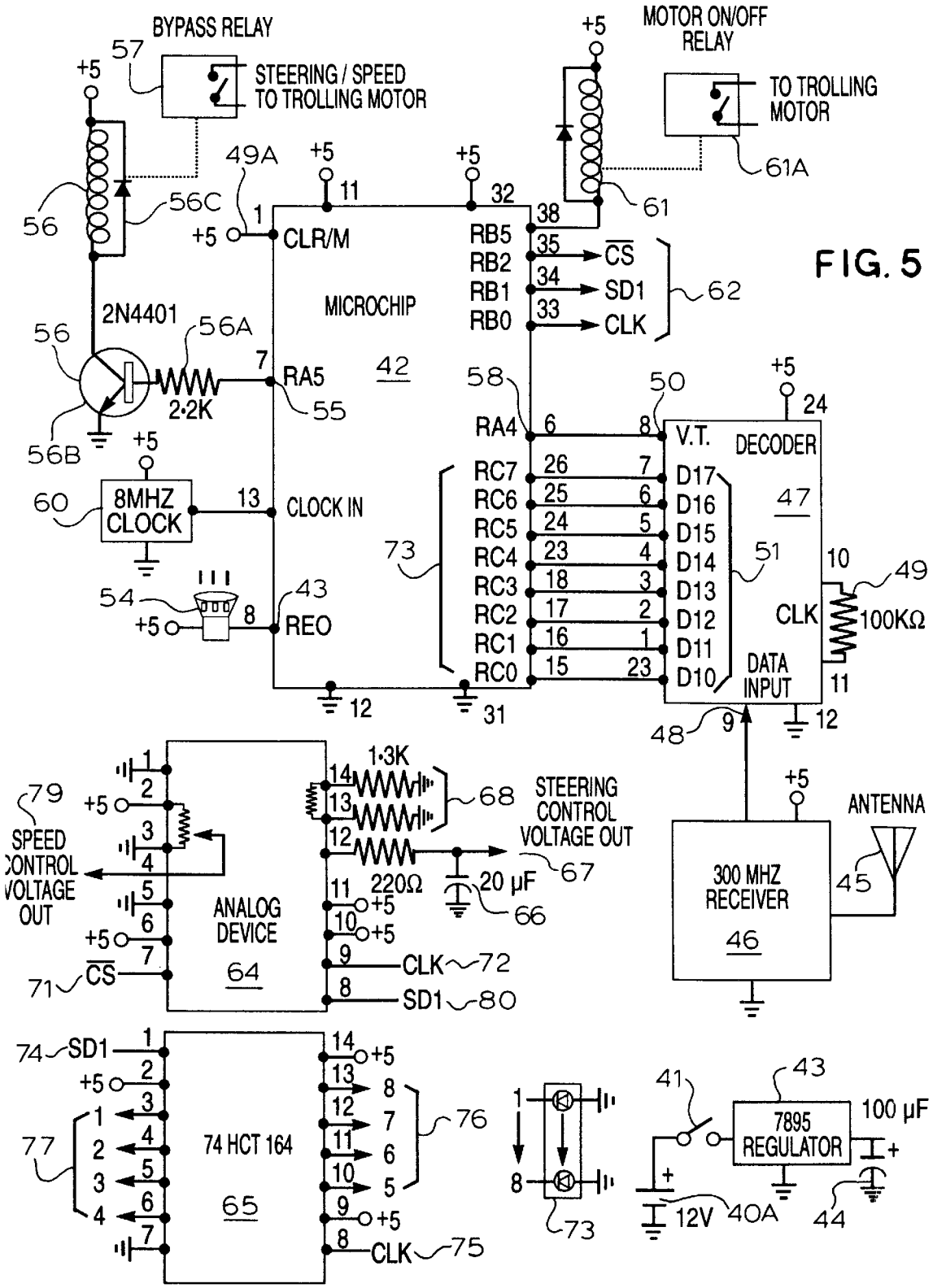
FIG. 5 is a schematic of the motor controller receiver.

FIG. 3 is the schematic diagram of the finger remote control 10. The power source is supplied by a mini 12 v battery 180 and is powered on and off by switch 20 which is regulated by +5 volts by a low current integrated circuit 22 such as a 16LC711 manufactured by National Semiconductor which, alternatively, could be replaced by a battery having an appropriate voltage. The low voltage IC 22 supplies constant voltage to the central processing unit 24, encoder 26, and transmitter 29 circuits. The CPU 24 is a software driven IC such as made by Microchip Corporation which controls all user interface functions, and all encoder/transmitter operations. All of the transmission codes are in eight bit hexidecimal format which are interpreted by the receiver CPU circuit 42 as shown in FIG. 5. The steering control 12 is, as previously mentioned, a slider potentiometer with a center detent 13, while the speed control 30 is a standard 25 k potentiometer. Both the speed 30 and steering 12 control's output values are analog to digitally converted by CPU 24 through RA ports 19. This is done with internal software. The motor on/off 14 and bypass on/off 15 switches are also scanned by the CPU 24 through RA ports 19. The CPU clock frequency is determined by clock circuit 27 which sets the CPU clock frequency to 32 KHZ. This slow speed reduces power drawn on the battery 180. The power up delay circuit 28 consists of a capacitor 28A, resistor 28B and diode 28C. Upon system power up the CPU 24 will not execute its software until the delay circuit 28 charges up.

Port B 20 is an eight bit output port outputting parallel information to the encoder IC 26 which then converts into a serial format and passes the data through the serial output port 21 which is connected to the 300 MHZ transmitter 28. Alternatively, encoder 26 may be eliminated by use of appropriate software in CPU 24. The data is then modulated and is transmitted over the airwaves by the antenna 23. This operation is initiated by activating the CPU transmit enable line 25. The transmitted bit clock format is determined by the encoder's 26 clock resistor 27.

Figure 4:
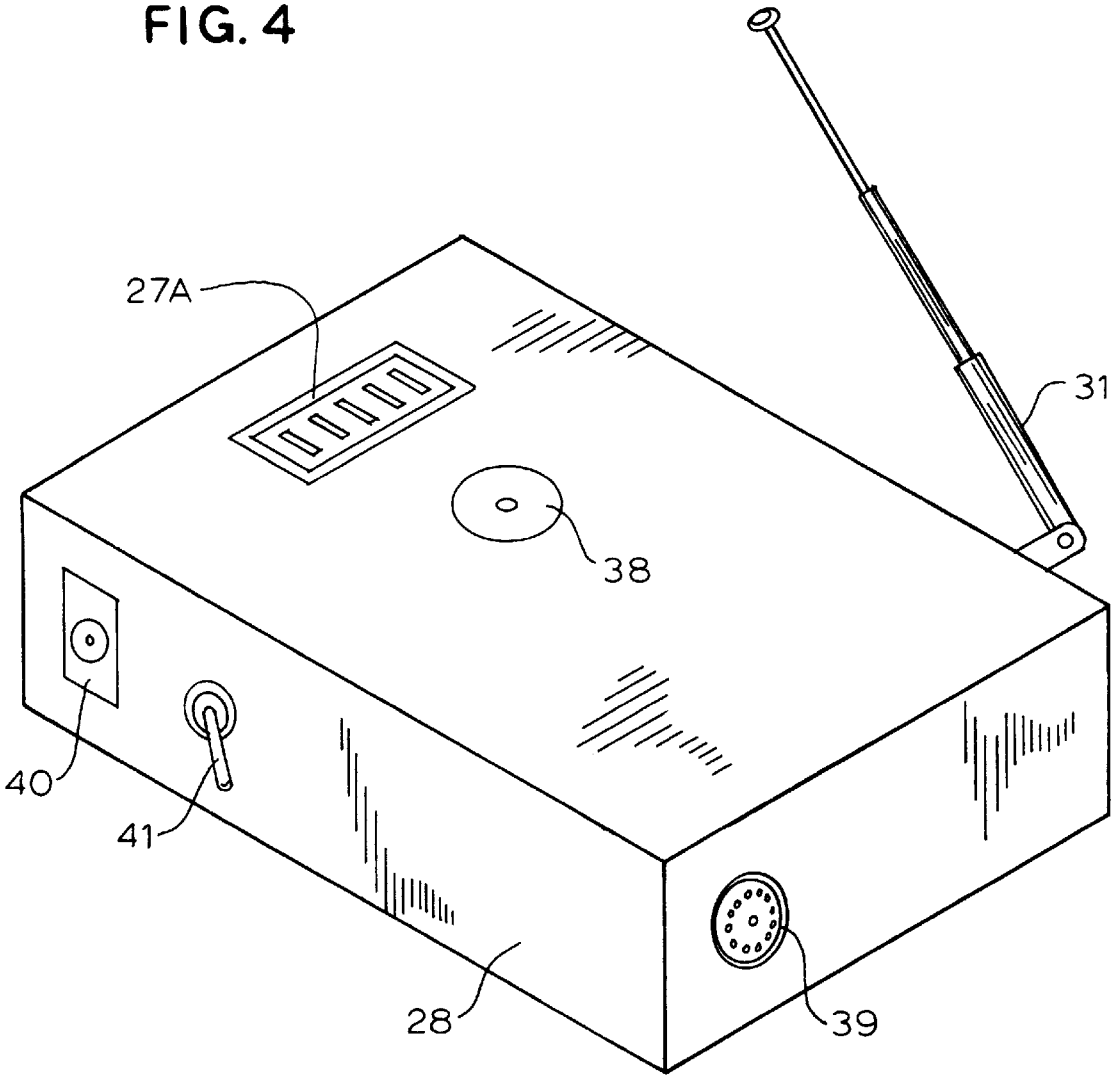
FIG. 4 is a plan view of the controller receiver.

In reference to FIG. 4, the receiver 28 receives its data from the airwaves through the antenna 31. Communication codes are visible at the LED bar graph 27A. This LED graph is used to interpret codes displaying information transmitted by the finger control 10. The speaker 38 is used as an audible alarm indicating when the propeller is turned onand off. All of the interfacing to the trolling motor is done through the interface connector 39. The power connection is connected to connector 40 which ties to a 12 volt boat battery 40A. The receiver power on/off switch 41 is used as the receiver master power switch.

In reference to FIGS. 5, power to the receiver 37 is turned off and on by the power switch 40 which connects to the boat's 12 volt starter battery 40A. A 7805 model +5 volt regulator 43 supplies a constant +5 VDC to all of the receiver's components. Filter cap 44 keeps the DC voltage stable and eliminates any power supply oscillation. Antenna 45 couples signals from the airwaves to the receiver circuit 46 which receives and amplifies the 300 MHZ AM frequency, which then passes the information to the decoding integrated circuit 47 through the data input line 48. Data is then decoded at a frequency determined by the clock oscillator resistor 49, and if valid information is received, the VT data line 50 is activated telling the CPU 42 there has been a valid eight bit transmission and the data is present at the decoder 47 parallel data bus 51. The CPU 42 loads in the information and determines if the eight bit code is a motor on/off, a speed control, a steering control, or a bypass control. Once determined, an action takes place. The CPU 42 interfaces and performs all functions through its data ports. Port REO 43 is used to sound a speaker 54 which indicates motor on or motor off by appropriate indicia, telling the fisherman whether the propeller is on or off. Port RA5 55 is the bypass circuit 56 which consists of a resistor 56A, transistor 56B, diode 56C and relay 57. This relay 57 connection interfaces into any standard electronic trolling motor and allows the fisherman to switch between a standard trolling motor foot control apparatus or the finger remote control 10. The RA4 Port 58 is used as an input and checks for a valid transmission enabled from the encoder's integrated circuit VT 50, The CLRM line 49A is held at +5 VDC for an internal auto power up delay. An eight MHZ oscillator 60 is used to clock the CPU 42. Port RB5 connects to a relay and diode circuit 61 which interfaces with the trolling motor's propeller on/off circuit 61A. Port lines RB0, RB1, and RB2 62 are the control lines to operate LED driver IC 65 and digitally controlled resistor IC 64. RC0–RC7 Ports 73 is an eight bit parallel port to receive transmitted data for the decoder IC 47. The digitally controllable resistor IC 64 is used to interface into the trolling motor to control the propeller speed and motor steering position. The resistor and capacitor circuit 66 is used as a slow charging circuit for a smoother control voltage. The control voltage line 67 interfaces into a servo style steering control motor. The two resistors in circuit 68 set up the steering left/right maximum limits. The control voltage-out line 79 interfaces into the trolling motor's speed control circuit. Serial data input 80 receives a ten bit serial shifted code from the CPU 42 and controls the values of both digital resistors in the resistor IC 64. The CS line 71 and clock line 72 allow for proper addressing and control for the resistor IC 64. The eight bit shift register IC 65 allows codes to be shifted and displayed across eight LEDs 73 and is used to display transmitted code values. The data 74 and clock 75 lines are used to shift in eight bit codes into the shift register IC 65. The eight bit output lines 76 and 77 connect to the eight LEDs 73 for visual displaying. It should be noted that the interfaces 57, 61, 67, and 69 to the trolling motor can be configured in many different ways to accommodate proper interfacing into all types of trolling motors on the market today, including a nonservo style trolling motor. When interfacing with a nonservo style trolling motor, the same finger controller 10 would be used, except two additional switches would be added in place of the slider potentiometer 12 to control the trolling motor's left/right turning movement.

The invention as described in the above detailed description of the presently preferred embodiment is merely indicative of the presently known best mode of practicing the invention and is not meant to limit the scope of the instant invention to any extent greater than denoted in the claims herebelow as equivalent structures to the one above recited are comtemplated to be expressly included in the below recited claims.

In accordance with my invention, I claim:

1. A method for controlling a boat motor in a boat wherein said boat motor has associated therewith a motor controller and said motor controller includes a transmitter and receiver adapted to respectively transmit and receive signals operative to effect control of said motor, and said transmitter is adapted to be affixable to a member wherein said member allows for an operator of said transmitter to simultaneously operate said transmitter and perform activities which require a movement about said boat and use of a plurality of hands associated with said operator, said method comprising the following steps:

Affixing said transmitter to said member;

Manipulating said transmitter so as to produce a signal operative to affect said receiver;

Effecting the reception of said signal by said receiver and;

Effecting a change in said motor in response to said signal.

2. The method according to claim 1 wherein said affixing said transmitter to said member further comprises placing said transmitter in removable engagement with a finger associated with said operator.

3. The method according to claim 1 wherein said affixing said transmitter to said member further comprises placing said transmitter in removable engagement with a fishing pole.

4. The method according to claim 1 wherein said effecting said change in said motor further comprises providing an output from said receiver.

5. The method according to claim 4 adapting said output to control a plurality of differing motors.

6. The method according to claim 1 digitally encoding said signal.

7. A trolling motor controller operative to control a motor associated with a boat wherein said controller comprehends a transmitter and a receiver and said transmitter and receiver are operative to transfer information therebetween, said controller comprising an analog to digital converter operative to convert an analog signal input to said transmitter by an operator into a digitally encoded signal configured so as to be received by said receiver, said signal containing information effective to control said motor.

8. The controller according to claim 7 and said analog signal being input to said analog to digital converter by means of manipulation of a potentiometer by said operator.

9. The controller according to claim 8 and a second potentiometer operative to effect a second type of control of said motor.

10. The controller according to claim 7 and said transmitter further comprising a first switch and a second switch wherein said first switch is operative to selectively disable said motor and said second switch is operative to bypass said transmitter and allow said receiver to be otherwise controlled.

11. The controller according to claim 10 and an integrated circuit operative to receive said inputs and arrange said inputs serially.

12. The controller according to claim 11 and said serial arrangement serving as a serial input to an associated means for digitally encoding said inputs.

13. The controller according to claim 12 and said digital encoder providing an output adapted to be modulated onto a wireless signal.

14. The controller according to claim 13 and said wireless signal comprising a radio wave.

15. The controller according to claim 14 and said radio wave comprehending an 8 bit digital encoding.

16. The controller according to claim 15 and a receiver adapted to receive said radio wave and interpret said digital encoding.

17. The controller according to claim 16 and said receiver further comprising a radio wave receiver, a digital decoder in electronic communication with said receiver, and wherein said decoder is adapted to provide a serial output operative to affect an integrated circuit associated therewith wherein said integrated circuit is further operative to, wherein said motor is capable of a plurality of operations, control said operations.

18. The controller according to claim 17 and a digitally controllable resistor integrated circuit operative to, wherein said motor has a variable speed, control said speed upon receipt of an appropriate signal from said integrated circuit associated with said decoder.

19. A trolling motor controller comprising a transmitting means for sending digitally encoded signals wherein said signals contain information corresponding to a desired effect on said trolling motor and a means for receiving said signals wherein said means for receiving said signals is further operative to cause a change, wherein said trolling motor has a plurality of operational states, the state of said trolling motor, and said means for receiving said signals is further adapted to control a plurality of different types of motors and said transmitting means is adapted to be releasably affixed to a member wherein said member allows an operator of said transmitter to simultaneously effect control of said transmitter and perform a plurality of operations requiring use of an operator's first hand and an operator's second hand while executing a simultaneous change in position.

20. The controller according to claim 19 and a means for releasably affixing said transmitting means to said member further comprising a first extension and a second extension wherein first extension comprehends a distal end and a proximal end and a medial area therebetween wherein said distal and proximal ends display a greater width than said medial area and said second extension displays a cuplike aspect.

* * * * *